US005318130A

United States Patent [19]

Manke

[11] Patent Number: 5,318,130

[45] Date of Patent: Jun. 7, 1994

[54] SELECTIVE DOWNHOLE OPERATING SYSTEM AND METHOD

[75] Inventor: Kevin R. Manke, Flower Mound, Tex.

[73] Assignee: Halliburton Company, Houston, Tex.

[21] Appl. No.: 928,266

[22] Filed: Aug. 11, 1992

[51] Int. Cl.[5] ..... E21B 34/10

[52] U.S. Cl. ..... 166/373; 166/386; 166/321

[58] Field of Search ..... 166/250, 336, 264, 321, 166/324, 380, 373

[56] References Cited

U.S. PATENT DOCUMENTS

| | | | |
|---|---|---|---|
| 3,856,085 | 12/1974 | Holden et al. | 166/336 X |
| 4,375,239 | 3/1983 | Barrington et al. | 166/336 |
| 4,378,850 | 4/1983 | Barrington | 166/373 |
| 4,422,506 | 12/1983 | Beck | 166/324 |
| 4,461,172 | 7/1984 | McKee et al. | 166/250 X |
| 4,633,952 | 1/1987 | Ringgenberg | 166/336 |
| 4,636,934 | 1/1987 | Schwendemann et al. | 166/336 X |
| 4,665,983 | 5/1987 | Ringgenberg | 166/250 |
| 4,711,305 | 12/1987 | Ringgenberg | 166/336 |
| 4,796,699 | 1/1989 | Upchurch | 166/250 |
| 4,856,595 | 8/1989 | Upchurch | 166/374 |
| 4,866,607 | 9/1989 | Anderson et al. | 364/422 |
| 4,896,722 | 1/1990 | Upchurch | 166/250 |
| 4,911,242 | 3/1990 | Hromas et al. | 166/321 X |
| 4,915,168 | 4/1990 | Upchurch | 166/250 |
| 4,971,160 | 11/1990 | Upchurch | 175/4.54 |
| 4,979,568 | 12/1990 | Spencer, III et al. | 166/321 X |
| 5,101,907 | 4/1992 | Schultz et al. | 166/336 X |
| 5,127,477 | 7/1992 | Schultz | 166/250 X |

*Primary Examiner*—Ramon S. Britts
*Assistant Examiner*—Frank S. Tsay
*Attorney, Agent, or Firm*—Tracy W. Druce; E. Harrison Gilbert, III

[57] ABSTRACT

A system for controlling a plurality of downhole apparatus comprises a housing inside which a biasing force is provided. An activating force can be received in the housing so that the activating force acts in opposition to the biasing force. The plurality of downhole apparatus are selectively operated in response to different magnitudes of the activating force acting in opposition to the biasing force. The present invention also provides a corresponding method.

35 Claims, 2 Drawing Sheets

SELECTIVE DOWNHOLE OPERATING SYSTEM AND METHOD

BACKGROUND OF THE INVENTION

This invention relates generally to systems and methods for operating downhole apparatus. The invention relates more particularly, but not by way of limitation, to a system and method for selectively actuating multiple downhole tools based on the amount of pressure applied to the annulus of an oil or gas well.

During the drilling, completing and producing of an oil or gas well, various apparatus typically need to be lowered into the well for one purpose or another. For example, a formation tester valve and a circulation valve are devices that are used to conduct a drill stem test. The tester valve is repeatedly opened and closed to allow and prevent oil or gas flow from the well so that the pressure in the well can be checked under such flow and shut-in conditions. After the desired cycling of the tester valve has been completed, the circulation valve is opened to allow fluid to be circulated between the surface and well.

Typically such downhole apparatus do not need to be operated until they are at a desired depth in the well. Thus, there is the need for some way to operate such apparatus when they are down in the well. Although such apparatus can be automatically self-controlled so that they perform desired operations at predetermined times, many such apparatus need to perform their functions at times that cannot be predetermined. For these apparatus, there needs to be some way of communicating from the surface a command signal that will initiate or otherwise affect operation of the apparatus.

This need for surface to downhole communication has been well recognized in the oil and gas industry, and many techniques have been developed For example, an apparatus can be lowered into a well on an electrically conductive cable, known as a wireline, so that electrical signals can be transferred between the surface and the apparatus down in the well. As other examples, an apparatus can be lowered into a well as part of a pipe string along which acoustic or electromagnetic signals can be sent. As a further example, pressure signals can be sent through fluid in a pipe string or in an annulus around the pipe string. A specific example of a downhole tool that responds to external annulus pressure and internal pressurized gas is shown in U.S. Pat. Nos. 4,633,952 and 4,711,305 to Ringgenberg.

SUMMARY OF THE INVENTION

The present invention provides a novel and improved system and method for operating downhole apparatus. In a particular application, the invention provides a system and method for selectively actuating multiple downhole apparatus based on the amount of pressure applied to the annulus of an oil or gas well. In a particular implementation of such application, the applied pressure causes a change in an internal volume. When a sufficient change occurs, a selected apparatus is operated. Thus, this particular type of operation is not dependent upon time, but rather it is dependent upon volumetric change so that operation of the selected apparatus will occur as long as the required change occurs.

The system of the present invention comprises: a housing; biasing means for providing a biasing force inside the housing; means for receiving into the housing an activating force so that the activating force acts in opposition to the biasing force; and means for selectively operating the plurality of downhole apparatus in response to different magnitudes of the activating force acting in opposition to the biasing force.

In a particular embodiment, the present invention provides a system for controlling a plurality of apparatus for performing respective functions in a well, comprising: a piston; a chamber having the piston disposed therein and further having a pressurized fluid therein on one side of the piston; means for communicating pressure from the well into the chamber on the other side of the piston so that communicated pressure greater than the pressure of the pressurized fluid in the chamber moves the piston in the chamber, the piston being moved to different positions in the chamber in response to different magnitudes of communicated pressure; piston position detecting means, connected to the chamber, for detecting the piston at respective positions in the chamber; and means, connected to the piston position detecting means, for operating at least a respective one of the apparatus for each respective position of the piston detected by the piston position detecting means.

The present invention also provides a method for controlling a plurality of downhole apparatus, comprising: providing a biasing force in a well; receiving an activating force so that the activating force acts in opposition to the biasing force in the well; and selectively operating in the well the plurality of downhole apparatus in response to different magnitudes of the activating force acting in opposition to the biasing force.

In a particular implementation, the present invention provides a method for controlling a plurality of apparatus for performing respective functions in a well, comprising: lowering a tool string into the well, the tool string including the plurality of apparatus; increasing pressure in the well to a first magnitude; moving a member to a first position in the tool string in response to the pressure at the first magnitude acting against the member and a pressurized fluid in the tool string; sensing when the member has moved to the first position and in response generating a control signal for a first respective one of the apparatus; increasing pressure in the well to a second magnitude; moving the member to a second position in the tool string in response to the pressure at the second magnitude acting against the member and the pressurized fluid in the tool string; and sensing when the member has moved to the second position and in response generating a control signal for a second respective one of the apparatus. More particularly, the member is a piston disposed for progressive linear movement within the tool string and the pressure is pressure in an annulus defined in the well outside the tool string.

Therefore, from the foregoing, it is a general object of the present invention to provide a novel and improved system and method for controlling a plurality of downhole apparatus. Other and further objects, features and advantages of the present invention will be readily apparent to those skilled in the art when the following description of the preferred embodiments is read in conjunction with the accompanying drawings:

DETAILED DESCRIPTION OF PREFERRED EMBODIMENTS

An Environment for the Invention

Before the present invention is further described, a description of one environment in which the present invention can be used will be given. This example is not to be limiting as to the nature of the present invention or its applications.

During the course of drilling an oil well, the borehole is filled with a fluid known as drilling fluid or drilling mud. One of the purposes of this drilling fluid is to contain in intersected formations any formation fluid which may be found there. To contain these formation fluids the drilling mud is weighted with various additives so that the hydrostatic pressure of the mud at the formation depth is sufficient to maintain the formation fluid within the formation without allowing it to escape into the borehole. Drilling fluids and formation fluids can all be generally referred to as well fluids.

When it is desired to test the production capabilities of the formation, a string of interconnected pipe sections and downhole tools referred to as a testing string is lowered into the borehole to the formation depth and the formation fluid is allowed to flow into the string in a controlled testing program.

Sometimes, lower pressure is maintained in the interior of the testing string as it is lowered into the borehole. This is usually done by keeping a formation tester valve in the closed position near the lower end of the testing string. When the testing depth is reached, a packer is set to seal the borehole, thus closing the formation from the hydrostatic pressure of the drilling fluid in the well annulus above the packer. The formation tester valve at the lower end of the testing string is then opened and the formation fluid, free from the restraining pressure of the drilling fluid, can flow into the interior of the testing string.

At other times the conditions are such that it is desirable to fill the testing string above the formation tester valve with liquid as the testing string is lowered into the well. This may be for the purpose of equalizing the hydrostatic pressure head across the walls of the test string to prevent inward collapse of the pipe and/or this may be for the purpose of permitting pressure testing of the test string as it is lowered into the well.

The well testing program includes intervals of formation flow and intervals when the formation is closed in. Pressure recordings are taken throughout the program for later analysis to determine the production capability of the formation. If desired, a sample of the formation fluid may be caught in a suitable sample chamber.

At the end of the well testing program, a circulation valve in the test string is opened, formation fluid in the testing string is circulated out, the packer is released, and the testing string is withdrawn.

Figure 1:
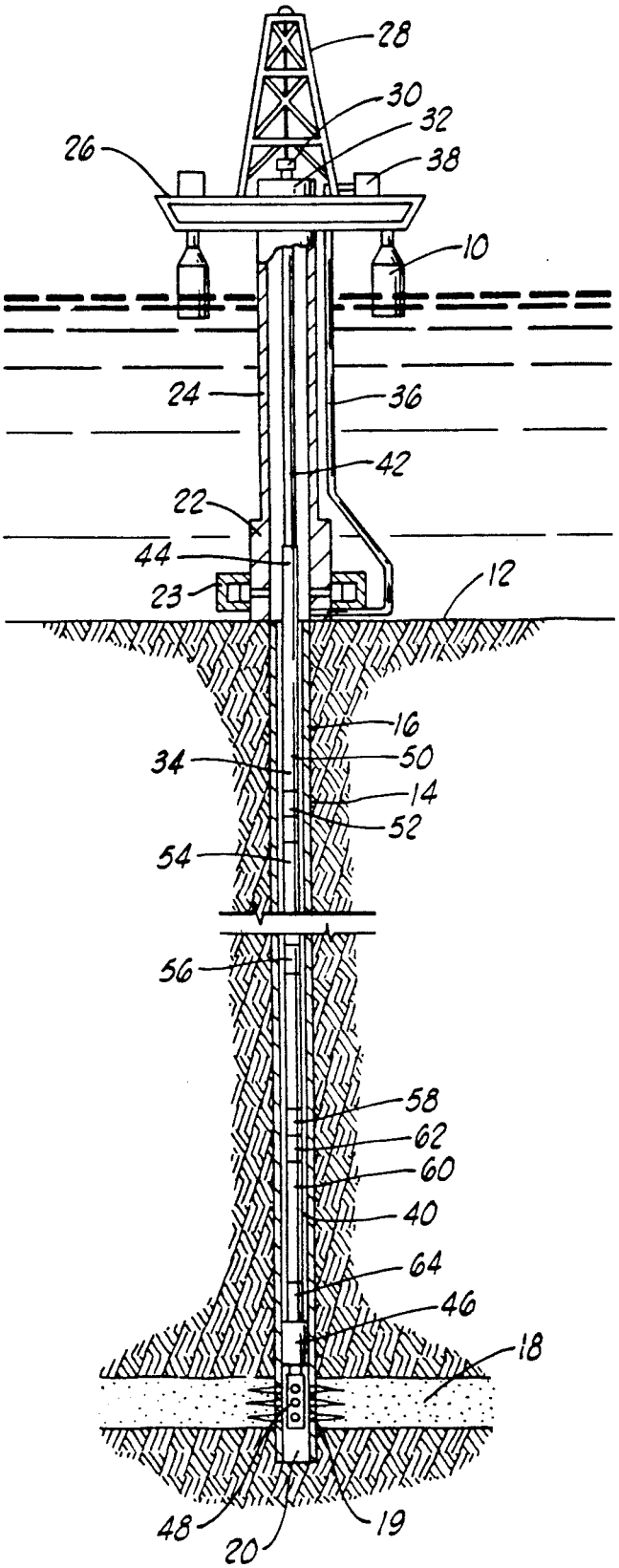
FIG. 1 is a schematic elevational view of a typical well test string in which the present invention can be used.

A typical arrangement for conducting a drill stem test offshore is shown in FIG. 1. Of course, the present invention may also be used on wells located on shore and in other applications with other types of tools.

The arrangement of the offshore system includes a floating work station 10 stationed over a submerged well site 12. The well comprises a well bore 14, which typically but not necessarily is lined with a casing string 16 extending from the submerged well site 12 to a subterranean formation 18.

The casing string 16 includes a plurality of perforations 19 at its lower end. These provide communication between the formation 18 and a lower interior zone or annulus 20 of the well bore 14.

At the submerged well site 12 is located the well head installation 22 which includes blowout preventer mechanisms 23. A marine conductor 24 extends from the well head installation 22 to the floating work station 10. The floating work station 10 includes a work deck 26 which supports a derrick 28. The derrick 28 supports a hoisting means 30. A well head closure 32 is provided at the upper end of the marine conductor 24. The well head closure 32 allows for lowering into the marine conductor 24 and into the well bore 14 a formation testing string 34 which is raised and lowered in the well by the hoisting means 30. The testing string 34 may also generally be referred to as a tubing string or a tool string.

A supply conductor 36 is provided which extends from a hydraulic pump 38 on the deck 26 of the floating station 10 and extends to the well head installation 22 at a point below the blowout preventer 23 to allow the pressurizing of a well annulus 40 defined between the testing string 34 and the well bore 14 or the casing 16 if present.

The testing string 34 includes an upper conduit string portion 42 extending from the work deck 26 to the well head installation 22. A subsea test tree 44 is located at the lower end of the upper conduit string 42 and is landed in the well head installation 22.

The lower portion of the formation testing string 34 extends from the test tree 44 to the formation 18. A packer mechanism 46 isolates the formation 18 from the fluids in the well annulus 40. Thus, an interior or tubing string bore of the tubing string 34 is isolated from the upper well annulus 40 above packer 46 unless other communication openings are provided. Also, the upper well annulus 40 above packer 46 is isolated from the lower well zone 20 which is often referred to as the rat hole 20.

A perforated tail piece 48 provided at the lower end of the testing string 34 allows fluid communication between the formation 18 and the interior of the tubular formation testing string 34.

The lower portion of the formation testing string 34 further includes intermediate conduit portion 50 and a torque transmitting pressure and volume balanced slip joint means 52. An intermediate conduit portion 54 is provided for imparting packer setting weight to the packer mechanism 46 at the lower end of the string.

It is many times desirable to place near the lower end of the testing string 34 a circulation valve 56. Below circulating valve 56 there may be located a combination sampler valve section and reverse circulation valve 58.

Also near the lower end of the formation testing string 34 is located a formation tester valve 60. Immediately above the formation testing valve 60 there may be located a drill pipe tester valve 62.

A pressure recording device 64 is located below the formation tester valve 60. The pressure recording device 64 is preferably one which provides a full opening passageway through the center of the pressure recorder to provide a full opening passageway through the entire length of the formation testing string.

The Present Invention

The preferred embodiment system of the present invention can, for example, be carried as part of the formation testing string 34 illustrated in FIG. 1. The system can control the plurality of functional tools that are included in the string 34 (e.g., the circulation valve 58, the formation tester valve 60, etc.). The present invention can also be used in other applications and with other apparatus. "Apparatus" as used herein and in the claims includes any type of circuit or device or part thereof that can be operated by the present invention; this includes without limitation electrical downhole tools, mechanical downhole tools, and parts thereof known in the art.

Figure 2:
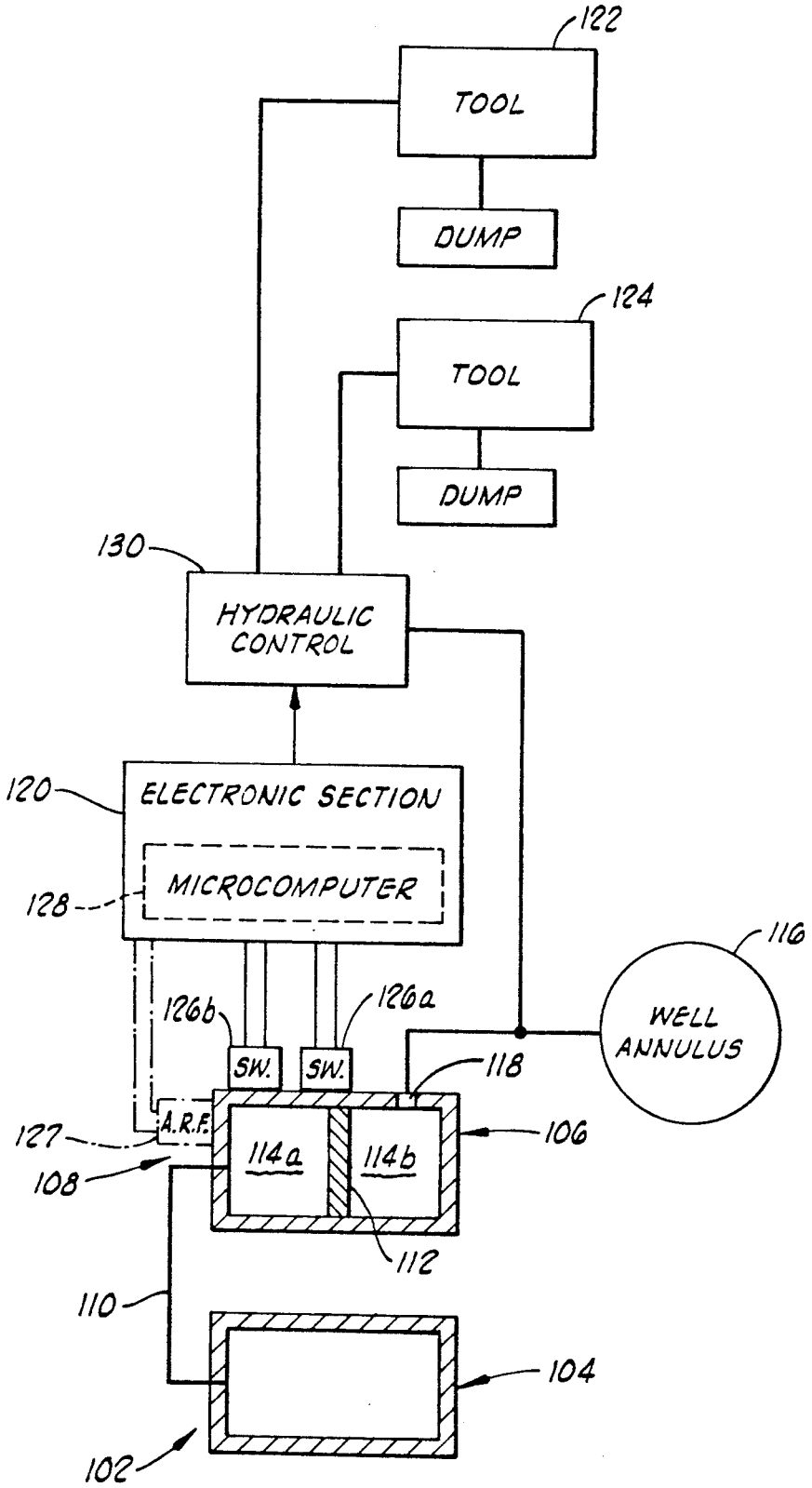
FIG. 2 is a schematic illustration of the system of the present invention adapted to control two downhole tools.

Referring to FIG. 2, the system of the present invention has a pressurized fluid section 102. This section includes a container 104 of pressurized fluid (e.g., nitrogen gas) that acts as a biasing means for providing a biasing force inside a housing 106 that forms part of a positioning section 108 of the system. The fluid-charged interior of the container 104 is in communication with the interior of the housing 106 as schematically indicated by conduit 110 in FIG. 2. The pressurized fluid inside the housing 106 acts as a variable spring while controlling the movement of a piston 112 also inside the housing 106. The pressurized fluid and positioning sections 102, 108 can be made as discrete components as represented in FIG. 2, but more likely they would be integrally constructed within their own or another downhole tool. It is contemplated that such a tool could include an outer case with a center mandrel through it. A floating piston would be located on one end of the mandrel, sealingly engaging both the mandrel and the outer case to act as a barrier between annulus fluid communicated into the case and nitrogen held in the case on the other side of the piston.

Further as to the positioning section 108, the housing 106 provides a chamber 114 having the piston 112 disposed therein so that the piston 112 divides the chamber 114 into two variable size chamber portions or volumes **114*a*, 114*b*. Chamber volume 114*a*receives pressurized fluid from the source container 104 on one side of the piston 112. Chamber volume 114*b* receives into the housing 106 an activating force so that the activating force acts in opposition to the biasing force as defined by the pressurized gas in chamber volume 114*a*. In the preferred embodiment, the activating force is increased pressure in an annulus 116 of a well where the present invention is used (in the FIG. 1 environment, this would be the annulus 40**).

The activating pressure communicated into the chamber volume **114*b* through suitable means, such as including a port 118 of the housing 106, acts on the piston 112 so that communicated activating pressure greater than the fluid pressure in the chamber volume 114*a*moves the piston 112 linearly in the chamber 114. The piston 112 is moved to different positions in the chamber 114 in response to different magnitudes of communicated activating pressure. That is, the piston 112 moves in response to a differential between the activating force in chamber volume 114*b* and the biasing force in chamber volume 114*a*. In the preferred embodiment, each of the different magnitudes of the activating force acting in the chamber volume 114*b* is greater than the biasing force that exists in the chamber volume 114*a* at the time the respective magnitude of activating force first acts in opposition to the biasing force. As the piston 112 moves, however, the chamber volume 114*a* decreases so that the pressure in the chamber volume 114*a* increases. The system is designed so that the pressure increases until it equals the activating force of the applied annulus pressure whereupon the piston 112** stops moving. The position at which the piston stops should be one at which the piston position is or will have been sensed as further explained hereinbelow. The different magnitudes of activating force are applied at different times in the preferred embodiment.

To respond to movement of the piston 112, the system of the present invention includes an electronic section 120. The electronic section 120 provides means for selectively operating the plurality of downhole apparatus, such as downhole tools 122, 124 depicted in FIG. 2, in response to different magnitudes of the activating force acting against the biasing force. A respective control signal for a respective apparatus is generated in response to a respective magnitude of annulus pressure that provides the activating force acting against the biasing force exerted by the pressurized fluid from the container 104. These signals are generated as a result of the progressive linear movement of the piston 112 in the housing 106.

These movements are detected by piston position detecting means, connected to the housing 106, for detecting the piston 112 at respective positions in the chamber 114. In one embodiment, this means includes a plurality of switches 126 (two switches **126*a*,126*b* shown in FIG. 2 to correspond to the two controlled downhole tools 122, 124, but more can be used and controlled). The switches 126 are disposed relative to the piston 112 so that the switches 126 are respectively operated in response to the piston 112 moving to different respective positions. In the illustrated embodiment, each of the switches 126 is connected to the housing 106 at a respective location along the linear path of movement of the piston 112 through the chamber 114. Such locations need not be linearly aligned. The switches can be any suitable mechanism sensitive to where the piston 112 is inside the housing 106**, such as magnetically or mechanically responsive proximity switches (preferably Hall Effect switches, but also magnetic reed switches or mechanical microswitches as other non-limiting examples).

In another, more preferred embodiment, an acoustic range finder device 127 also represented in FIG. 2 would be used instead of the switches **126*a*, 126*b*. With this device the electronic section 120 would be set up to operate a given apparatus when the piston 112 has moved a predetermined amount as determined by the acoustic signals sent out by device 127 and returned thereto. It is contemplated that the technology of conventional devices such as used for indicating tank levels and fluid depths (e.g., depth finders for fishing boats) can be adapted for implementing the device 127** of the present invention.

The means for selectively operating the downhole apparatus also includes means, connected to the switches 126 (or other change sensing devices), for operating at least a respective one of the apparatus for each respective position of the piston 112 detected by the switches 126. This is implemented using a computer connected to receive inputs in response to the switches 126 and to provide outputs for controlling the plurality of apparatus, each of the outputs corresponding to a respective one of the inputs so that each switch 126 is related to a respective apparatus. Thus, this computer responds to different magnitudes of the activating force acting against the biasing force. As shown in FIG. 2, the computer is preferably implemented with a microcomputer 128 that receives inputs from the switches 126. The microcomputer 128 is programmed to react to the number of position switches that have been activated. The microcomputer 128 can be implemented by any suitable microprocessor, memory and ancillary devices and circuits known in the art. An example of suitable components that can be adapted for use in the present invention are shown in U.S. Pat. No. 4,866,607 to Anderson et al., incorporated herein by reference. See also, for example, U.S. Pat. No. 4,971,160 to Upchurch, incorporated herein by reference.

The electronic section 120 also includes the power supply and ancillary circuitry as needed to operate a hydraulic control circuit 130 by which annulus fluid/-pressure is diverted to operate the tools 122, 124 in a known manner. That is, under control of the microcomputer 128, the hydraulic control circuit 130 directs the porting of pressure from the well annulus 116 into the operating circuit of the tool to be controlled. While hydrostatic and applied pressure is ported to one side of the operating circuit of an apparatus, the other side of the operating circuit is ported to a region of lower pressure. This region of lower pressure can be an atmospheric dump chamber, as illustrated in FIG. 2, or a pressurized fluid (e.g., nitrogen gas) chamber that is at a lower pressure, such as in the Halliburton Services LPR-N Tester Valve. The differential created in this way is the driving force necessary to operate the tool. Types of such pressure control through a hydraulic control circuit are known in the art (see, for example, related U.S. Pat. Nos. 4,796,699; 4,856,595; 4,915,168; 4,896,722 to Upchurch, incorporated herein by reference; an example of a similar type of a hydraulic control circuit, but driven by an internal pressure instead of annulus pressure, is shown in U.S. Pat. No. 4,378,850 to Barrington, incorporated herein by reference).

To use the system of the present invention, the pressurized fluid section 102 is charged at the surface to a predetermined pressure dependent upon downhole temperature and pressure. This is for use in providing a biasing force in the well once the system is lowered into the well. Preferably, the biasing force is pressurized gas having a magnitude at least equal to a hydrostatic pressure at the location in the well where the system is to be used and the method of the present invention is to be performed. Alternatively, the pressurized gas source can be hooked to a metering section that will balance the gas pressure with hydrostatic pressure. This will fix the positioning piston 112 in its initial relation to the position switches 126.

Once the system is placed in the well, such as by lowering it into the well as part of the string 34 shown in FIG. 1, a selected increased pressure level is applied from the surface to the well annulus 116 (annulus 40 in FIG. 1). This pressure is received as an activating force in the housing 106 so that the activating force acts in opposition to the biasing force exerted in the chamber volume **114*a* by the pressurized fluid from the container 104. As the received annulus pressure increases above hydrostatic (or other preset level of the biasing pressure), the piston 112 begins to move within the chamber 114, thereby enlarging the volume 114*b* and reducing the volume 114*a*. The switches 126 are disposed and the housing 106 and piston 112 are constructed so that the piston 112 reaches the first switch 126*a* in response to a first predetermined pressure level or magnitude being reached in the well annulus 116. The piston 112 linearly moves progressively to different positions in the well (i.e., specifically, in the housing 106**) in response to different magnitudes of the activating force acting in opposition to the biasing force.

At least during sequential operation, when the piston 112 reaches or passes an actuating range of the first switch **126*a*, the switch is actuated so that a signal is provided to the microcomputer 128. In response, the microcomputer 128 generates a signal to operate the hydraulic control circuit 130 so that the selected respective tool 122 or 124 that is correlated to the switch 126*a* is activated. If a higher pressure level is applied to the well annulus 116 so that the piston 112 is moved to actuate the switch 126*b*, then the microcomputer 128 responds by operating the hydraulic control circuit 130 to control the other of the tools 122, 124. Thus, the method of the present invention also comprises selectively operating in the well the plurality of downhole apparatus in response to different magnitudes of the activating force acting in opposition to the biasing force. Such operating includes: sensing the piston 112 reaching different positions in the housing 106; and generating a respective control signal for a respective apparatus in response to sensing the piston 112 at a respective location. This can also be accomplished using the preferred acoustic range finder 127 to generate signals indicating where the piston 112** is.

The microcomputer 128 preferably responds either to relatively slow sequentially distinct actuations of the switches 126 (as just described) or to rapid movement of the piston 112 past one or more switches 126 to another of the switches. As to the former, the pressure in the well annulus 116 would be incrementally increased such as, for example, to 1000 psi, then later to 1500 psi, etc., with each incremental increase moving the piston 112 to the next switch 126 location. The microcomputer 128 would, in this case, respond to each switch operation individually as described above. As to the latter, a lower predetermined pressure level would be rapidly passed. For example, if the first applied pressure rapidly increased the well annulus pressure to 1500 psi (using the pressures of the previous example), this would move the piston 112 past the switch **126*a* directly to the switch 126*b* location. In this case, the microcomputer 128 can be programmed to either control both tools 122, 124 (because both switches would be actuated as the piston 112 moves past the switch 126*a* and arrives at or past the switch 126*b*) or only tool 124 (assuming it is the one corresponding to switch 126*b*). Control of only tool 124 can be implemented by programming the microcomputer 128 to detect the time difference between receiving inputs from the switches 126**. If the time between two switches being actuated is less than a predetermined minimum, the microcomputer would assume that only a pressure level selecting the last switch had been applied.

The preferred embodiments of the present invention can be implemented using known types of materials and components suitable for use in the well environments where particular applications are to occur.

Thus, the present invention is well adapted to carry out the objects and attain the ends and advantages mentioned above as well as those inherent therein. While preferred embodiments of the invention have been described for the purpose of this disclosure, changes in the construction and arrangement of parts and the performance of steps can be made by those skilled in the art, which changes are encompassed within the spirit of this invention as defined by the appended claims.

What is claimed is:

1. A system for controlling a plurality of downhole apparatus, comprising:

a housing;

biasing means for providing a biasing force inside said housing;

means for receiving into said housing an activating force so that the activating force acts in opposition to the biasing force; and means for selectively operating the plurality of downhole apparatus in response to different magnitudes of the activating force acting in opposition to the biasing force.

2. A system as defined in claim 1, wherein said biasing means includes a pressurized gas inside said housing.

3. A system as defined in claim 2, wherein the activating force is increased annulus pressure in a well.

4. A system as defined in claim 1, wherein the activating force is increased annulus pressure in a well.

5. A system as defined in claim 1, wherein said means for selectively operating includes means for generating a respective control signal for a respective apparatus in response to a respective magnitude of pressure providing the activating force.

6. A system as defined in claim 1, wherein:

said means for receiving includes a piston linearly movable in said housing; and said means for selectively operating includes means for generating signals in response to progressive linear movement of said piston in said housing.

7. A system as defined in claim 1, wherein:

said means for receiving includes a piston disposed in said housing so that said piston moves in response to a differential between the activating force and the biasing force; and said means for selectively operating includes a plurality of switches disposed relative to said piston so that said switches are respectively operated in response to said piston moving to different respective positions in said housing.

8. A system as defined in claim 7, wherein said means for selectively operating further includes a computer connected to receive inputs in response to said switches and to provide outputs for controlling the plurality of apparatus, each of the outputs corresponding to a respective one of the inputs so that each switch is related to a respective apparatus.

9. A system as defined in claim 8, wherein said biasing means includes a pressurized gas inside said housing and further wherein the activating force is increased annulus pressure in a well.

10. A system as defined in claim 1, wherein each of the different magnitudes is greater than the biasing force existing at the time the respective magnitude of activating force first acts in opposition to the biasing force.

11. A system as defined in claim 1, wherein:

said means for receiving includes a piston disposed in said housing so that said piston moves in response to a differential between the activating force and the biasing force; and said means for selectively operating includes an acoustic range finder device disposed relative to said piston so that said acoustic range finder device generates signals in response to said piston moving to different respective positions in said housing.

12. A system for controlling a plurality of downhole apparatus, comprising:

a housing;

biasing means for providing a biasing force inside said housing;

means for receiving into said housing an activating force so that the activating force acts in opposition to the biasing force; and computer means for operating the plurality of downhole apparatus in response to different magnitudes of the activating force acting in opposition to the biasing force.

13. A system as defined in claim 12, wherein said biasing means includes a pressurized gas inside said housing.

14. A system as defined in claim 13, wherein the activating force is increased annulus pressure in a well.

15. A system as defined in claim 12, wherein the activating force is increased annulus pressure in a well.

16. A system as defined in claim 12, wherein said computer means generates a respective control signal for a respective apparatus in response to a respective magnitude of pressure providing the activating force.

17. A system as defined in claim 12, wherein:

said means for receiving includes a piston linearly movable in said housing; and said computer means generates signals in response to progressive linear movements of said piston in said housing.

18. A system as defined in claim 12, wherein:

said means for receiving includes a piston disposed in said housing so that said piston moves in response to a differential between the activating force and the biasing force; and said system further comprises a plurality of switches disposed relative to said piston so that said switches are respectively operated in response to said piston moving to different respective positions in said housing, said switches connected to said computer means.

19. A system as defined in claim 18, wherein said biasing means includes a pressurized gas inside said housing and further wherein the activating force is increased annulus pressure in a well.

20. A system as defined in claim 12, wherein each of the different magnitudes is greater than the biasing force existing at the time the respective magnitude of activating force first acts in opposition to the biasing force.

21. A system as defined in claim 12, wherein:

said means for receiving includes a piston disposed in said housing so that said piston moves in response to a differential between the activating force and the biasing force; and said system further comprises an acoustic range finder device disposed relative to said piston so that said acoustic range finder device provides signals to said computer means in response to said piston moving to different respective positions in said housing.

22. A system for controlling a plurality of apparatus for performing respective functions in a well, comprising:

a piston;

a chamber having said piston disposed therein and further having a pressurized fluid therein on one side of said piston;

means for communicating pressure from the well into said chamber on the other side of said piston so that communicated pressure greater than the pressure of the pressurized fluid in said chamber moves said piston in said chamber, said piston being moved to different positions in said chamber in response to different magnitudes of communicated pressure;

piston position detecting means, connected to said chamber, for detecting said piston at respective positions in said chamber; and means, connected to said piston position detecting means, for operating at least a respective one of said apparatus for each respective position of said piston detected by said piston position detecting means.

23. A system as defined in claim 22, wherein said piston position detecting means includes a plurality of switches, each of said switches connected to said chamber at a respective location along a linear path of movement of said piston through said chamber.

24. A system as defined in claim 23, wherein said means for operating includes a microcomputer connected to said switches.

25. A system as defined in claim 22, wherein said means for operating includes a microcomputer.

26. A system as defined in claim 22, wherein said piston position detecting means includes an acoustic range finder device connected to said chamber and said means for operating.

27. A method for controlling a plurality of downhole apparatus, comprising:

providing a biasing force in a well;

receiving an activating force so that the activating force acts in opposition to the biasing force in the well; and selectively operating in the well the plurality of downhole apparatus in response to different magnitudes of the activating force acting in opposition to the biasing force.

28. A method as defined in claim 27, wherein said selectively operating includes generating a respective control signal for a respective apparatus in response to a respective magnitude of pressure providing the activating force.

29. A method as defined in claim 27, wherein the biasing force is pressurized gas having a magnitude at least equal to a hydrostatic pressure at the location in the well where said method is performed.

30. A method as defined in claim 29, wherein the activating force is annulus pressure increased to a predetermined magnitude in response to surface control outside the well, the predetermined magnitude being greater than the hydrostatic pressure.

31. A method as defined in claim 27, wherein the activating force is annulus pressure increased to a predetermined magnitude.

32. A method as defined in claim 27, wherein:

receiving an activating force includes progressively linearly moving a piston to different positions in the well in response to the different magnitudes of the activating force acting in opposition to the biasing force; and selectively operating includes sensing the piston reaching the different positions.

33. A method for controlling a plurality of apparatus for performing respective functions in a well, comprising:

lowering a tool string into the well, the tool string including the plurality of apparatus;

increasing pressure in the well to a first magnitude;

moving a member to a first position in the tool string in response to the pressure at the first magnitude acting against the member and a pressurized fluid in the tool string;

sensing when the member has moved to the first position and in response generating a control signal for a first respective one of the apparatus;

increasing pressure in the well to a second magnitude;

moving the member to a second position in the tool string in response to the pressure at the second magnitude acting against the member and the pressurized fluid in the tool string; and sensing when the member has moved to the second position and in response generating a control signal for a second respective one of the apparatus.

34. A method as defined in claim 33, wherein the member is a piston disposed for progressive linear movement within the tool string.

35. A method as defined in claim 33, wherein the pressure is pressure in an annulus defined in the well outside the tool string.

* * * * *